US006267620B1

(12) United States Patent
Ma

(10) Patent No.: US 6,267,620 B1
(45) Date of Patent: Jul. 31, 2001

(54) FLEXIBLE BOARD ELECTRICAL CONNECTOR WITH AN IMPROVED PRESSURE MEMBER

(75) Inventor: Hao Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/803,698

(22) Filed: Mar. 8, 2001

(30) Foreign Application Priority Data

Dec. 30, 2000 (TW) ..... 89222906

(51) Int. Cl.[7] ..... H01R 12/24

(52) U.S. Cl. ..... 439/495; 439/260; 439/492

(58) Field of Search ..... 439/495, 496, 439/492, 499, 493, 260, 261

(56) References Cited

U.S. PATENT DOCUMENTS 6,056,571 * 5/2000 Noro ..... 439/492

* cited by examiner

*Primary Examiner*—Tho D. Ta
(74) *Attorney, Agent, or Firm*—Wei Te Chung

(57) ABSTRACT

A flexible board electrical connector (100) comprises an insulative housing (102) defining an opening (118) for insertion of a flexible board (F), a number of conductive contacts (104) and a pressure member (106) both assembled with the housing. The pressure member comprises a pair of shaft portions (126) forming a pair of first positioning bars(130) projecting from opposite outside surfaces (1262) thereof for insertion into elongated holes (120) defined in the housing. A second positioning bar (123) is further formed on one shaft portion for insertion into a recess (117) defined in one side wall (121) of the housing, and, together with the first positioning bars, retains the pressure member to the housing when the flexible board is inserted into the opening.

6 Claims, 7 Drawing Sheets

FLEXIBLE BOARD ELECTRICAL CONNECTOR WITH AN IMPROVED PRESSURE MEMBER

BACKGROUND OF THE INVENTION

1. Field of the Invention

The present invention relates to a flexible board electrical connector for connecting a Flexible Printed Circuit (FPC) board to another printed circuit board, and particularly to a flexible board connector having an improved pressure member.

2. Description of Prior Art

Conventional flexible board connectors are disclosed in U.S. Pat. Nos. 4,778,403, 5,458,506, 5,639,260 and 5,580, 272. Referring to FIG. 8, a conventional flexible board connector 1' comprises a dielectric housing 2' defining a plurality of contact channels 20' in a bottom wall thereof, a corresponding number of conductive contacts 3' received in the contact channels 20', and a pressure member 4'. The pressure member 4' is pivotably mounted to opposite sides of the housing 2' for pressing a FPC board (not shown) against the conductive contacts 3'. When the pressure member 4' is turned to an open position as shown in FIG. 8, the flexible board is inserted into the housing 2' from an opening 22' defined in the left-hand side of the housing 2'. When the pressure member 4' is consequently turned counterclockwise to a closed position, substantially in a horizontal orientation, it presses the flexible board downward to make an electrical connection between the flexible board and the contacts 3'. However, the pressure member 4' is easy to shake or rotate in the open position since no positioning or retaining means is provided thereto.

Hence, a flexible board connector with an improved pressure member is required to overcome the disadvantages of the prior art.

BRIEF SUMMARY OF THE INVENTION

A first object of the present invention is to provide a flexible board electrical connector having a pressure member which is reliably held in an open position; and A second object of the present invention is to provide a flexible board electrical connector forming a positioning means for a pressure member thereof, wherein the positioning means is easily manufactured and low in cost.

A flexible board electrical connector for connecting a flexible board to another printed circuit board comprises an insulative housing, a plurality of conductive contacts and a pressure member both assembled to the housing. The housing defines an L-shaped opening on a front side thereof and a plurality of contact channels on a bottom wall thereof for receiving the contacts therein. A pair of support arms, having certain resilience, extend from opposite sides of the housing and each defines an elongated hole therein. A channel is defined between each support arm and an adjacent side wall of the housing with a predetermined width and wherein one channel forms a recessed section at a lower portion thereof. One side wall of the housing adjacent to the recessed section defines a recess on a top portion thereof. The pressure member comprises an elongated pressure section and a pair of shaft arms extending from opposite ends thereof. The shaft arm has a first positioning bar on an outside surface thereof for insertion into the elongate hole of the housing. The shaft arms can be rotated with respect to the first positioning bars between an open position where the flexible board is inserted into the opening of the housing and a closed position where the pressure member presses the flexible board against the contacts. One shaft arm corresponding to the channel having the recessed section further forms a second positioning bar on an inner surface thereof for insertion into the recess of the side wall of the housing. The first and the second positioning bars together prevent the pressure member from shaking or rotating in the open position.

Other objects, advantages and novel features of the invention will become more apparent from the following detailed description of the present embodiment when taken in conjunction with the accompanying drawings.

DETAILED DESCRIPTION OF THE INVENTION

Figure 1:
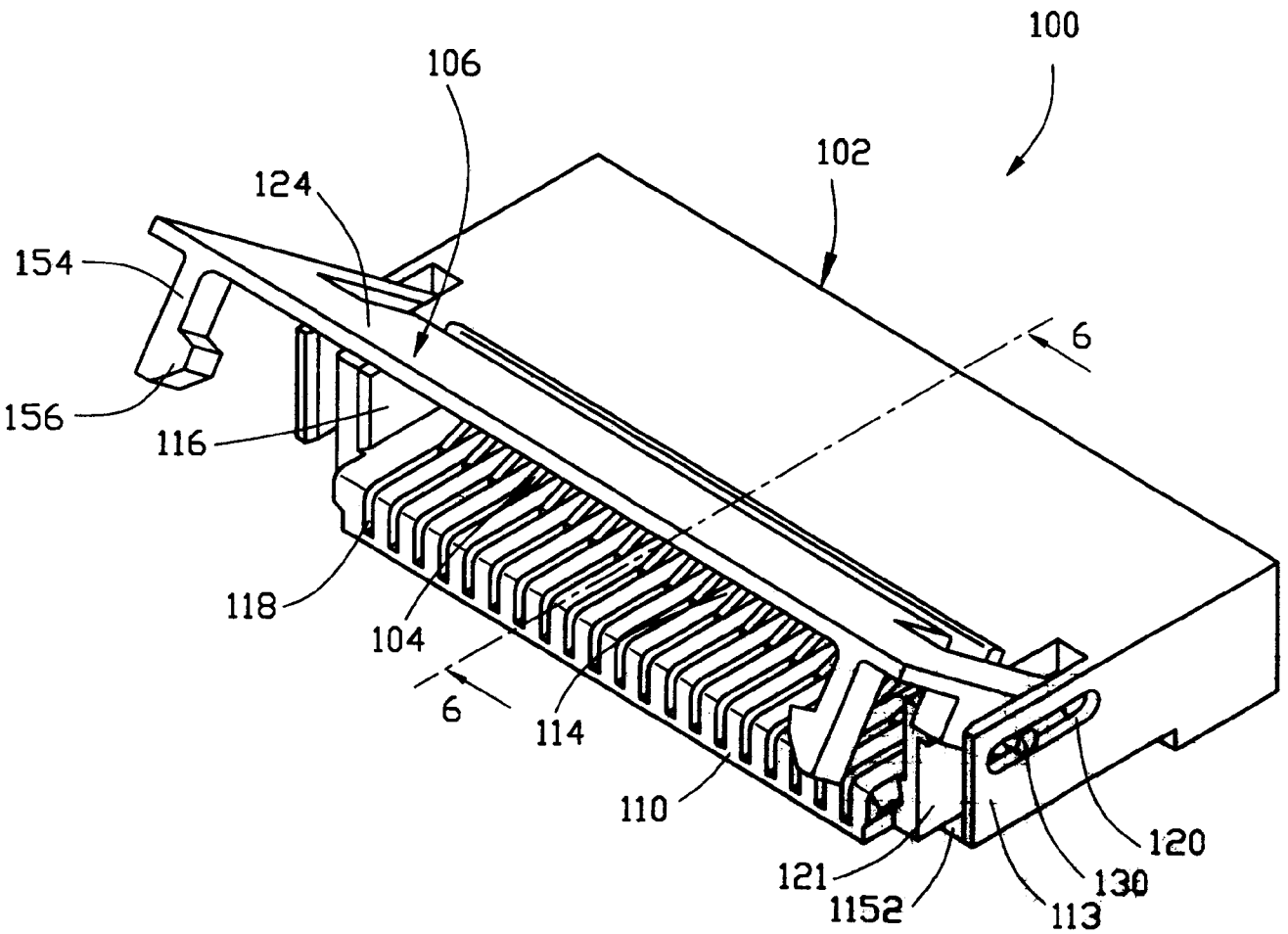
FIG. 1 is an assembled perspective view of a flexible board electrical connector in accordance with the present invention.
Figure 2:
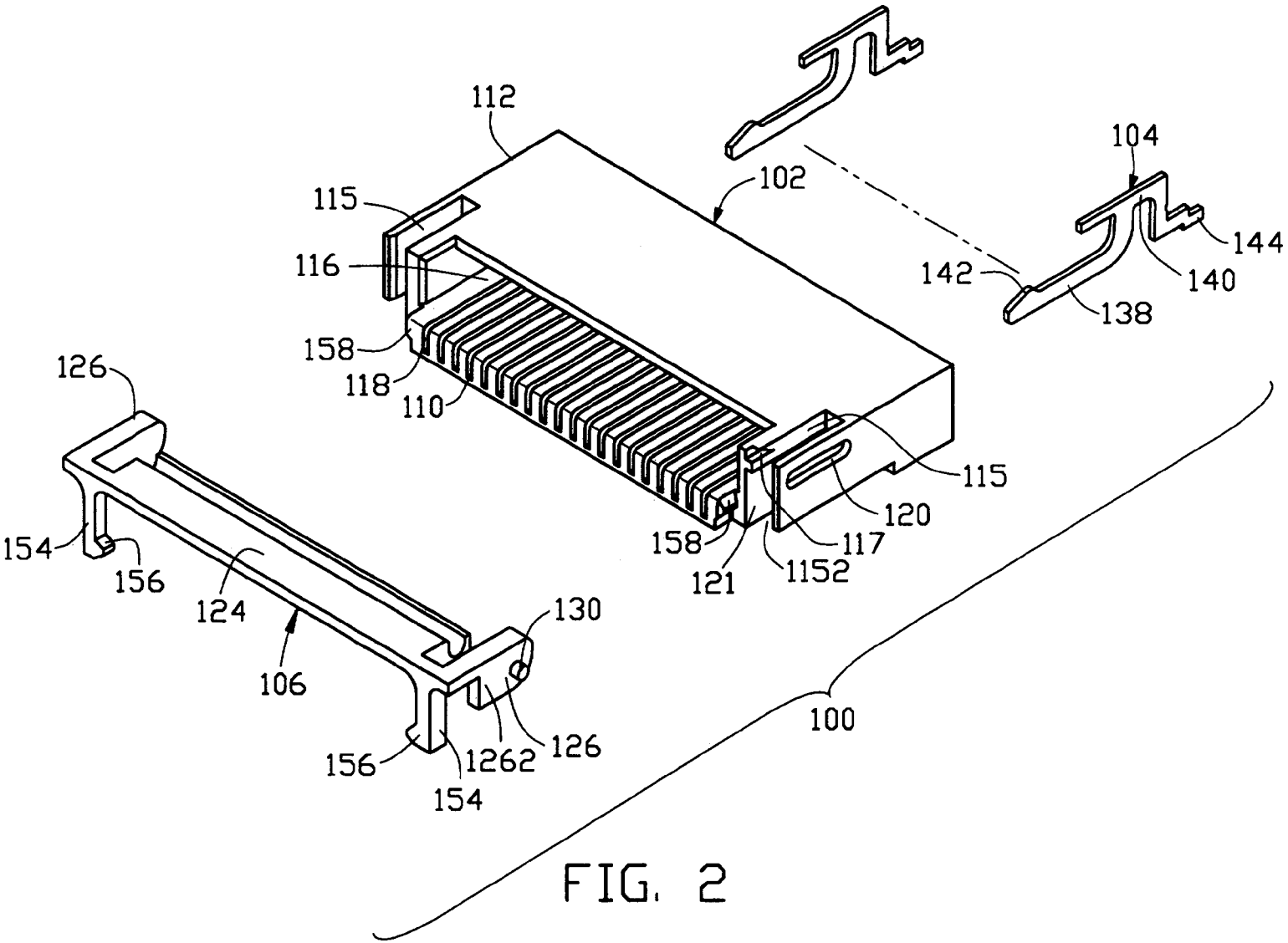
FIG. 2 is an exploded perspective view of FIG. 1.

Referring to FIGS. 1 to 2, a flexible board electrical connector 100 in accordance with the present invention comprises a dielectric housing 102, a plurality of conductive contacts 104 retained in the housing 102 and a pressure member 106 hinged to opposite sides of the housing 102.

Figure 5:
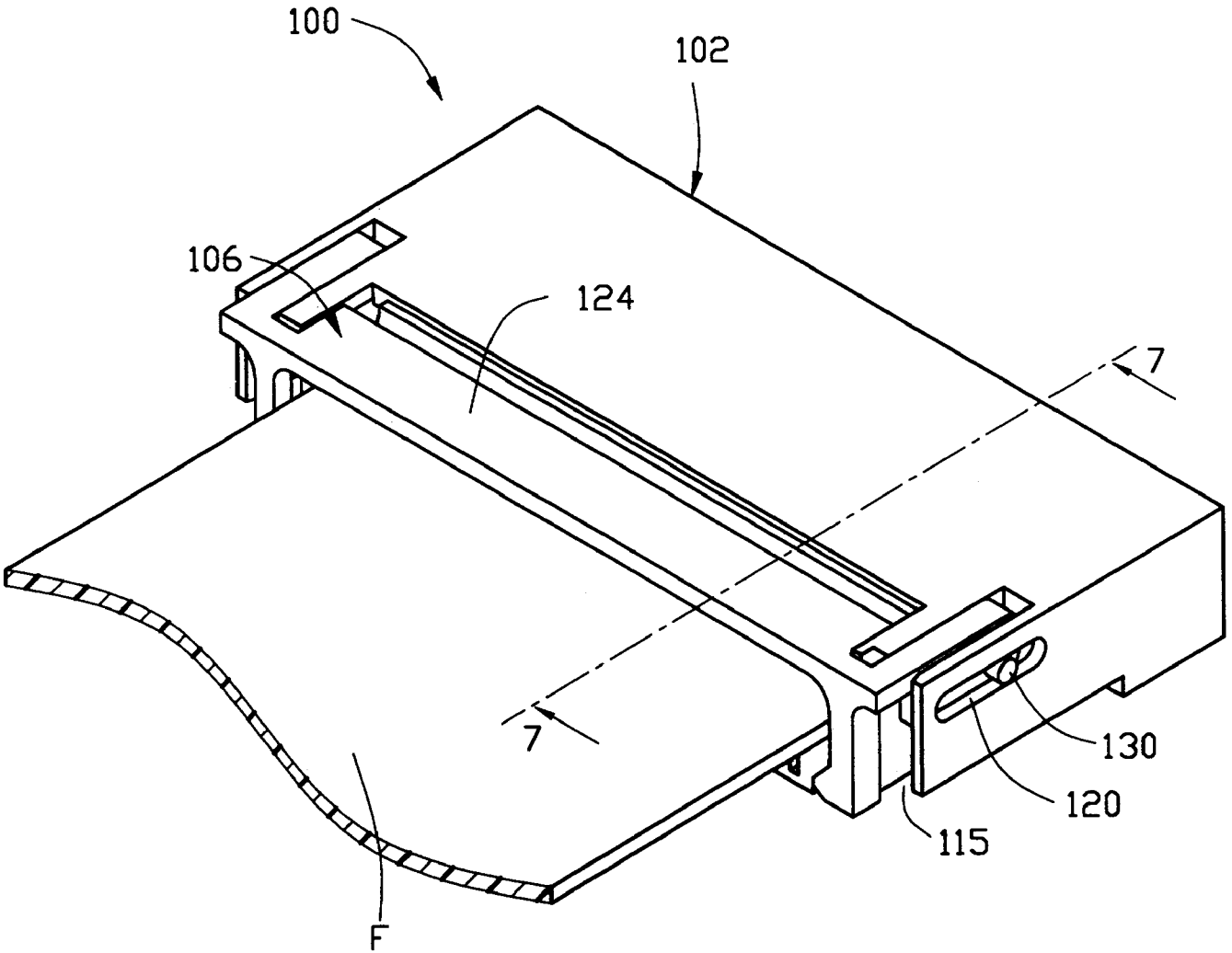
FIG. 5 is an assembled view of the electrical connector of FIG. 1 with a flexible board.

The housing 102 defines an L-shaped opening 116 on a front side thereof for receiving the pressure member 106 and a flexible board F as shown in FIG. 5. A plurality of contact channels 118 are formed at regular intervals on a bottom wall 1 10 of the housing 102 to receive the corresponding contacts 104 therein. The bottom wall 110 forms a pair of projections 158 extending outward from opposite sides thereof. A pair of support arms 113 having certain resilience are formed at opposite sides of the housing 102. Each support arm 113 is spaced apart from an adjacent side wall 121 of the housing 102 with a channel 115 having predetermined width therebetween and further defines an elongated hole 120 therein. One channel 115 includes a recessed section 1152 at a lower portion thereof. The side wall 121 adjacent to the recessed section 1152 defines a recess 117 in a top portion thereof.

Each contact 104 forms a contact portion 138, a solder portion 144 for soldering to a mother board (not shown) and a link portion 140 for coupling these two portions 138 and 144. The contact portion 138 forms a contact point 142 on the tip end thereof.

Figure 3:
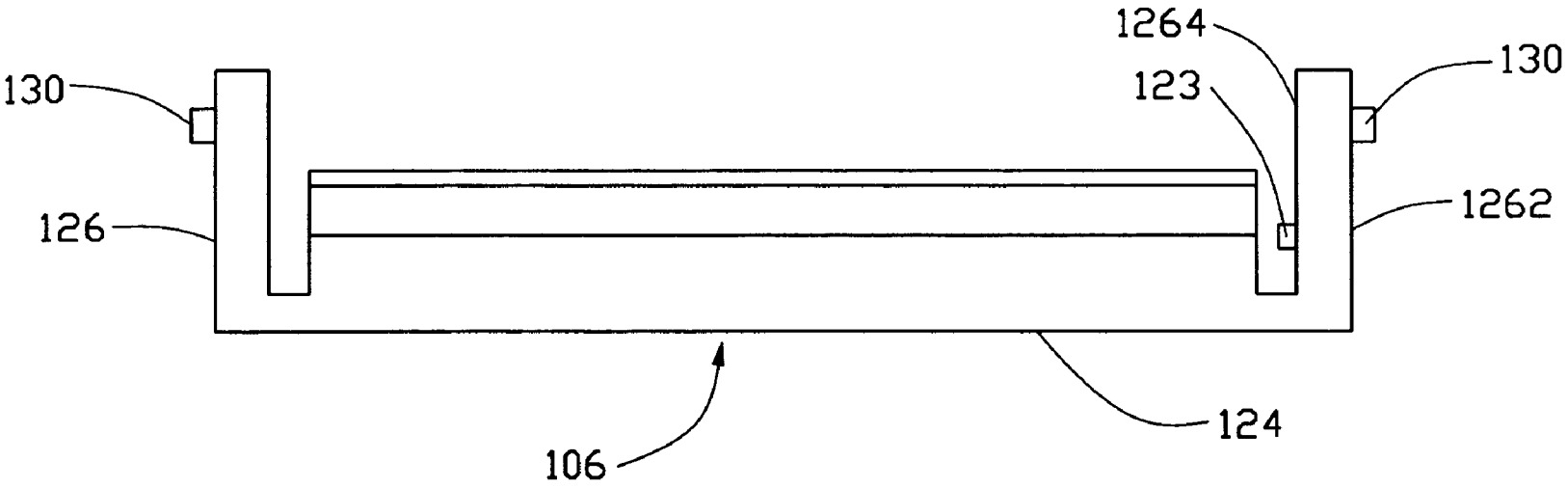
FIG. 3 is a top view of a pressure member of FIG. 2.

Further referring to FIG. 3, the pressure member 106 comprises an elongated pressure section 124, a pair of shaft portions 126 and a pair of latching legs 154 extending horizontally and vertically from opposite ends of the pressure section 124, respectively. A pair of first positioning bars

130 extend outward from opposite outer surfaces 1262 of the shaft portions 126 for insertion into the two elongated holes 120 of the housing 102. One shaft portion 126 associated with the recessed section 115 of the housing 102 further forms a second positioning bar 123 on an inside surface 1264 thereof for insertion into the recess 117 of the housing 102. The shaft portion 126 including the second positioning bar 123 is sized to be accommodated in the corresponding channel 115 having the recessed section 1152. Additionally, the latching legs 154 form a pair of latches 156 facing each other on tip ends thereof for engaging with the projections 158 of the housing 102.

Figure 4:
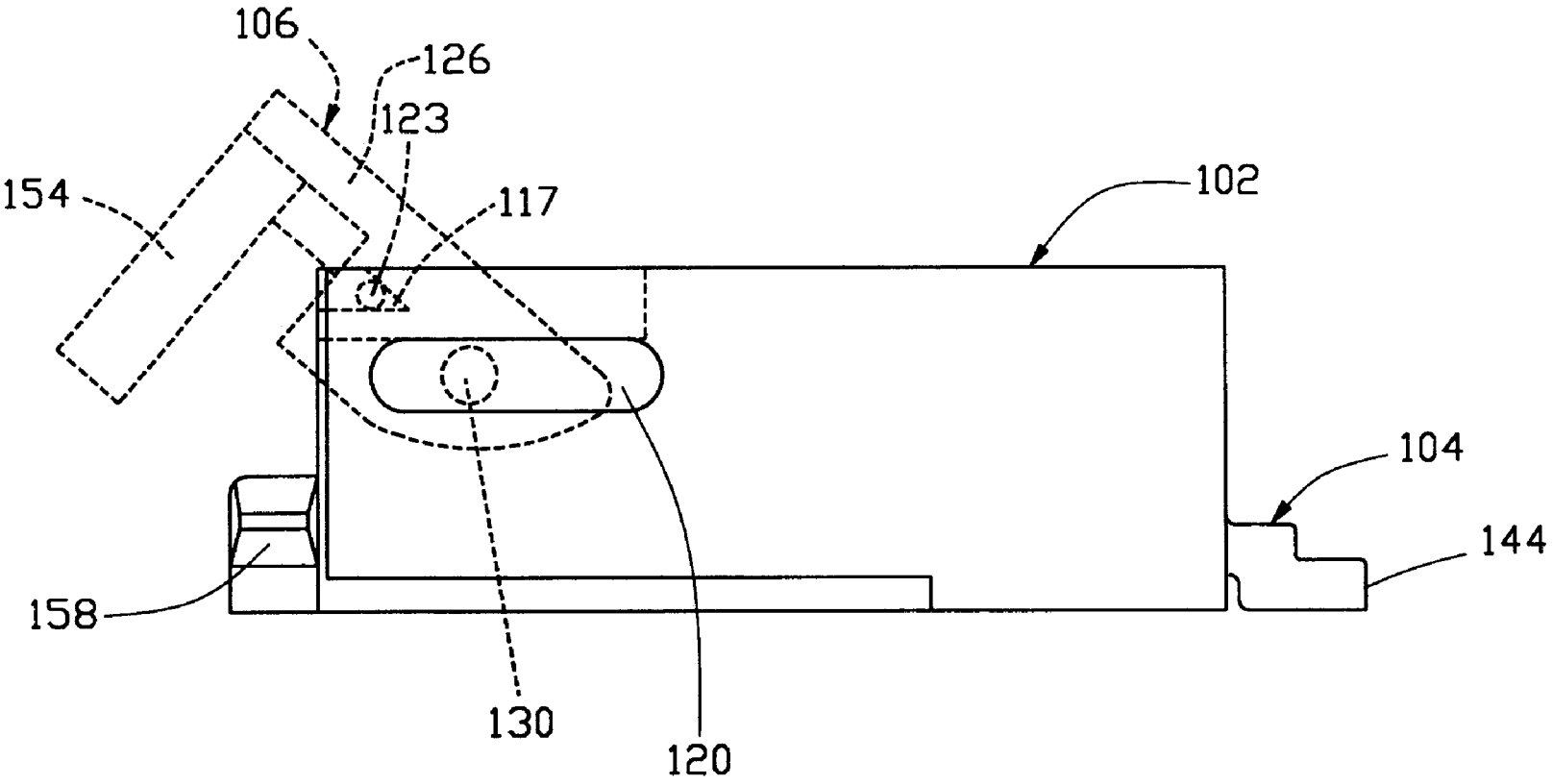
FIG. 4 is side view of FIG. 1 showing an engagement between the pressure member and a dielectric housing thereof.

Referring to FIGS. 1, 2 and 4, in assembly, the conductive contacts 104 are inserted into corresponding contact channels 118 of the housing 102. The first positioning bars 130 of the pressure member 106 are inserted into the elongated holes 120 of the housing 102 by the supporting arms 113 being slightly expanded outward. At the same time, the second positioning bar 123 is mounted into the recess 117 of the housing 102. Therefore, the pressure member 106 is located in an open position and can be steadily positioned without shaking or rotating due to the positional relationship between the three positioning bars 130 and 123, as is best seen in FIG. 4.

Figure 6:
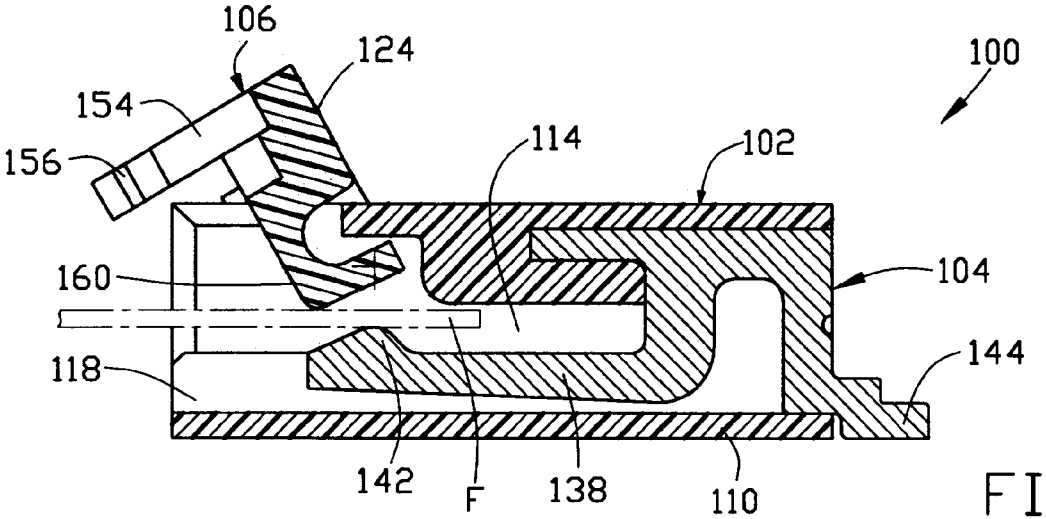
FIG. 6 is a cross-sectional view taken along line 6—6 of FIG. 1 with a flexible board assembled into the electrical connector thereof.
Figure 7:
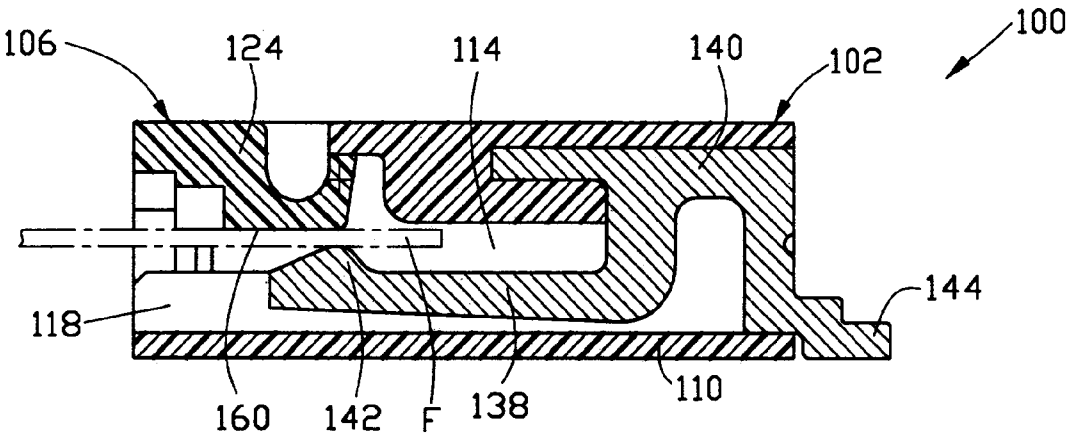
FIG. 7 is a cross-sectional view of FIG. 5.
Figure 8:
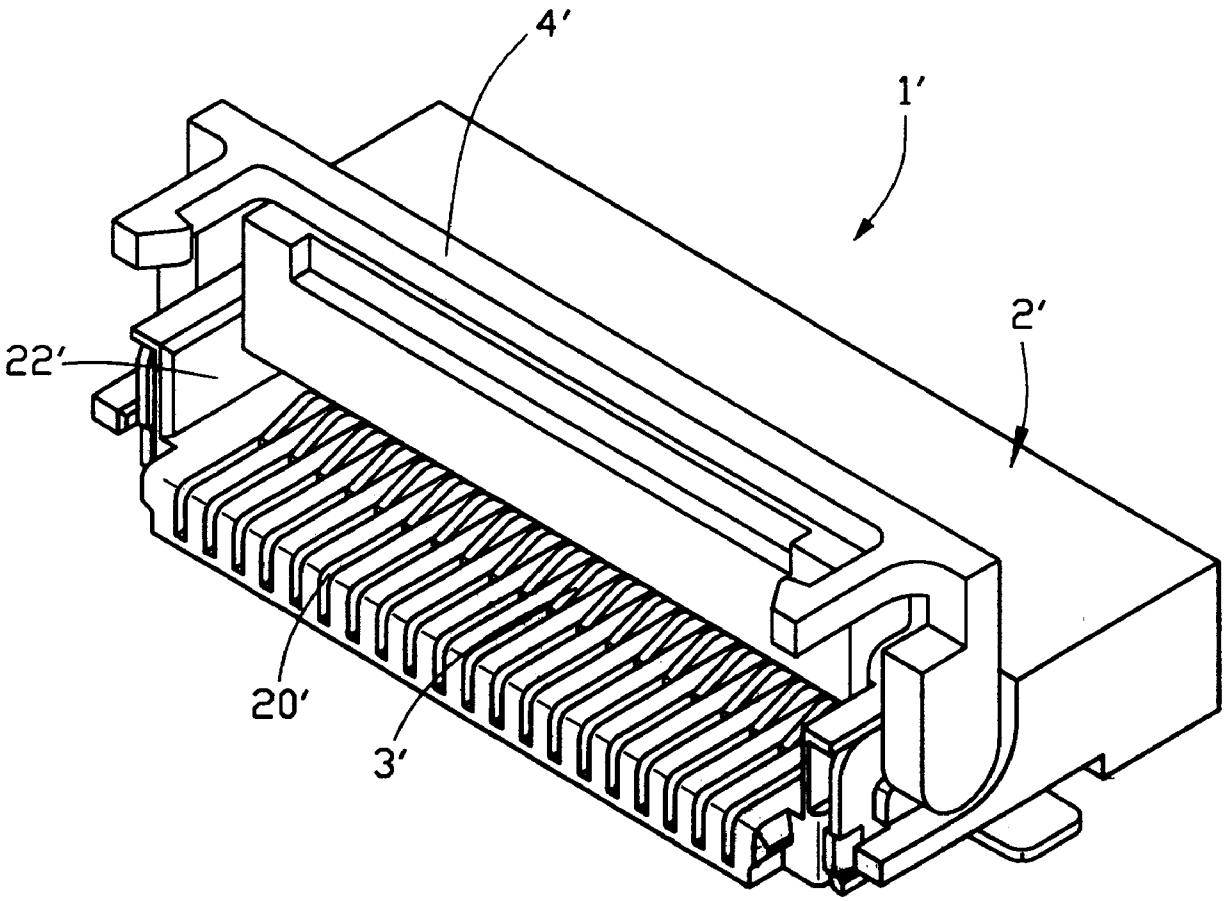
FIG. 8 (PRIOR ART)
FIG. 8 is a perspective view of a prior art electrical connector.

In operation, referring to FIGS. 5 to 7, after the flexible board F has been inserted into the housing 102 from the opening 118, the pressure member 106 is pulled forward with the first and second positioning bars 130, 123 moving forward along the elongated holes 120 and the recess 117, respectively, until the second positioning bar 123 slides into the enlarged recess section 1152 of the channel 115. Then, the pressure section 124 is pushed rearward and downward with a bottom press face 160 thereof consequently pressing against an upper surface of the flexible board F until the latches 156 of the pressure member 106 engage with corresponding projections 158 of the housing 102. At this time, the pressure member 106 is located in a closed position so as to make the conductive conductors of the inserted flexible board F electrically connect with the corresponding contact points 142 of the contacts 104.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed. For example, in an alternate embodiment, the elongated hole 120 may be applied to the shaft portion 126 and the positioning bar 130 may be applied to the support arm 113 corresponding.

What is claimed is:

1. A flexible board electrical connector for connecting a flexible printed circuit (FPC) board to another printed circuit board, comprising:

an insulative housing defining an opening on a front side thereof, a plurality of contact channels on a bottom wall thereof, and a pair of support arms formed on opposite sides thereof, each support arm is spaced apart from an adjacent side wall of the housing, each support arm defining an elongated hole therein;

a plurality of conductive contacts being received in the contact channels; and a pressure member being rotatably and slidably engaged with the elongated holes of the support arms for rotating between an open position where the FPC board is inserted into the opening and a closed position where the pressure member presses the FPC board to electrically contact with the contacts, wherein the pressure member forms a shaft portion for engaging with the space between the support arm and the adjacent wall of the housing; wherein a positioning means is formed on the pressure member and the housing to retain the pressure member to the insulative housing when in the open position.

2. The flexible board electrical connector as claimed in claim 1, wherein a recessed section is formed on a lower portion of the channel, and a recess is defined in atop portion of one side wall adjacent to the recessed section of the channel, wherein the pressure member forms an elongated pressure section and a pair of shaft portions and a pair of latching legs extending horizontally and vertically from opposite ends of the pressure section, respectively, the shaft portions forming a pair of first positioning bars extending outward from opposite outer surfaces thereof for insertion into the elongated holes of the support arms of the housing, and wherein one shaft portion corresponding to the channel having the recessed section has a second positioning bar extending from an inner surface thereof for insertion into the recess of the side wall of the housing, thereby, together with the two first positioning bars, preventing the pressure member from shaking or rotating in the open position.

3. A flexible board electrical connector for connecting a flexible printed circuit (FPC) board to another printed circuit board, comprising:

an insulative housing defining an opening on a font side thereof; a plurality of contact channels on a bottom wall thereof, a pair of support portions formed on opposite sides thereof, each support portion is spaced apart from an adjacent side wall of the housing, and a recess defined in a top portion of one of the side walls thereof, each support portion defining an elongated hole therein;

a plurality of conductive contacts being received in the contact channels; and a pressure member being rotatable and slidably engaged with the support portions of the housing for rotating between an open position where the FPC board is inserted into the opening and a closed position where the pressure member presses the FPC board against the contacts, and including a pair of shaft portions and an elongated press section between the shaft portions, wherein the shaft portion engaging with the space between the support portion and the adjacent wall of the housing; wherein a pair of first positioning bars and a second positioning bar are formed on the shaft portions for insertion into the elongated holes and the recess of the housing, respectively, thereby retaining the pressure member to the insulative housing when in the open position.

4. A flexible board electrical connector for connecting a flexible printed circuit (FPC) board to another printed circuit board, comprising:

an insulative housing defining an opening on a front side thereof, a plurality of contact channels on a bottom wall thereof, and a pair of support arms formed on opposite sides thereof, each support arm is spaced apart from an adjacent side wall of the housing, each support arm defining an elongated hole along a lengthwise direction thereof;

a plurality of conductive contacts being received in the contact channels;

a pressure member being rotatably and slidably engaged with the elongated holes of the support arms for rotating between an open position where the FPC board is inserted into the opening and a closed position where the pressure member presses the FPC board to electrically contact with the contacts; means for retaining the pressure member relative to the housing when said pressure member is in the opening position; and means for securing the pressure member to the housing when said pressure member is in the closed portion;

wherein said pressure member defines a pair of shaft portions with a pair of first positioning bars thereon, respectively, each to cooperate with the corresponding elongate hole for guiding movement the pressure member relative to the housing; and wherein the shaft portion engaging with the space between the support arm and the adjacent wall of the housing.

5. The connector as claimed in claim 4, wherein said means for securing the pressure member to the housing includes a pair of latching legs downwardly extending from two opposite ends of the pressure member.

6. The connector as claimed in claim 4, wherein said means of retaining the pressure member to the housing includes at least one second positioning bar formed on one of said pair of shaft portions opposite to the corresponding first positioning bar for engaging with said recess.

* * * * *